United States Patent [19]

Aykut

[11] 4,237,674

[45] Dec. 9, 1980

[54] APPARATUS FOR INTRODUCING STACKS OF PAPER SHEETS INTO BOXES

[75] Inventor: Kurt Aykut, Hamburg, Fed. Rep. of Germany

[73] Assignee: Hauni-Werke Körber & Co. KG, Hamburg, Fed. Rep. of Germany

[21] Appl. No.: 965,502

[22] Filed: Dec. 1, 1978

[30] Foreign Application Priority Data

Dec. 17, 1977 [DE] Fed. Rep. of Germany ..... 2756473

[51] Int. Cl.[3] ..... B65B 57/20; B65B 39/50; B65B 39/12

[52] U.S. Cl. ..... 53/249

[58] Field of Search ..... 53/248, 249, 251, 252, 53/477

[56] References Cited

U.S. PATENT DOCUMENTS

| | | | |
|---|---|---|---|
| 2,747,353 | 5/1956 | Shibata | 53/249 |
| 2,996,859 | 8/1961 | Winkler et al. | 53/252 X |
| 3,084,489 | 4/1963 | Seefluth | 53/477 |
| 3,555,773 | 1/1971 | Rowekamp | 53/251 X |
| 3,735,552 | 5/1973 | Derderian | 53/251 X |
| 3,920,134 | 11/1975 | Scarpa et al. | 53/251 X |
| 3,932,983 | 1/1976 | Hughes | 53/252 |
| 4,138,836 | 2/1979 | Crowe et al. | 53/249 X |

*Primary Examiner*—Horace M. Culver
*Attorney, Agent, or Firm*—Peter K. Kontler

[57] ABSTRACT

Apparatus for introducing stacks of paper sheets into boxes has a receptacle for reception of stacks which are delivered by a feeding conveyor or a transfer conveyor and a bottom consisting of two sections which are movable in a horizontal plane toward each other to support a stack in the receptacle and away from each other to allow the stack to descend by gravity into an empty box therebelow. Empty boxes are supplied onto a platform which is located below the bottom of the receptacle, and filled boxes are removed from the platform by a carriage which is reciprocable along the platform and has pushers for moving an empty box below the receptacle while moving a filled box onto a receiving conveyor.

25 Claims, 8 Drawing Figures

Fig. 2
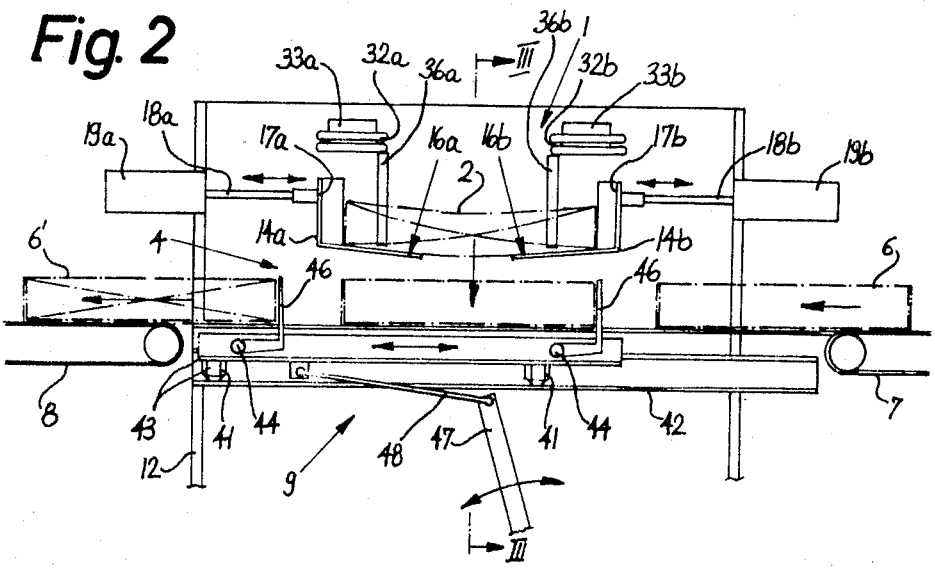
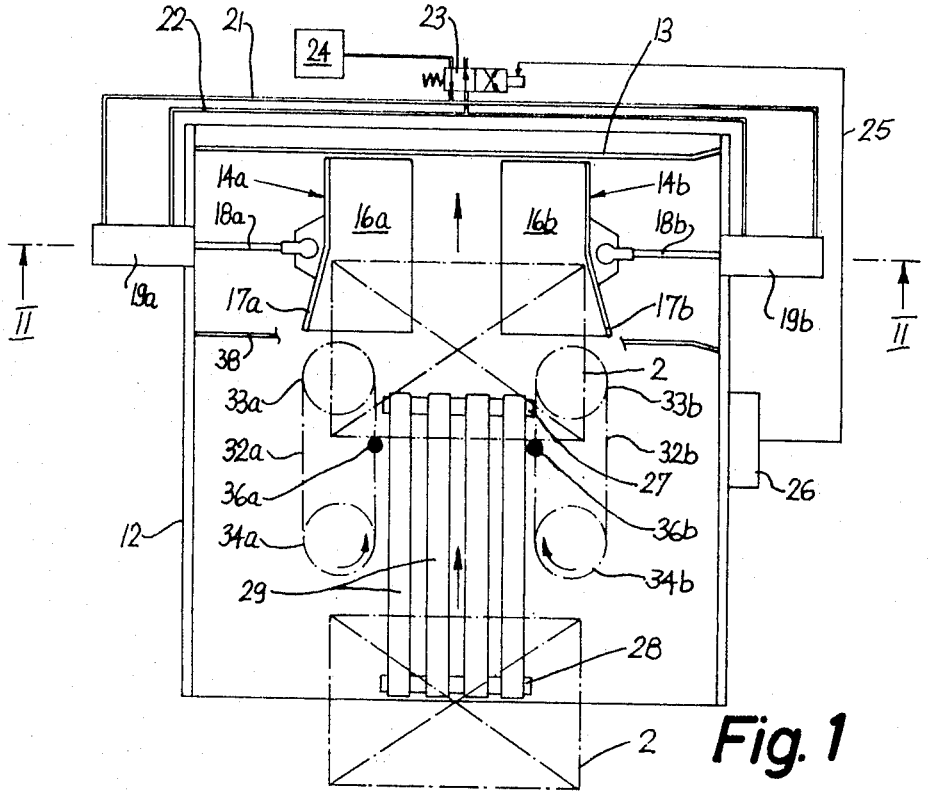
Fig. 1

Fig.5
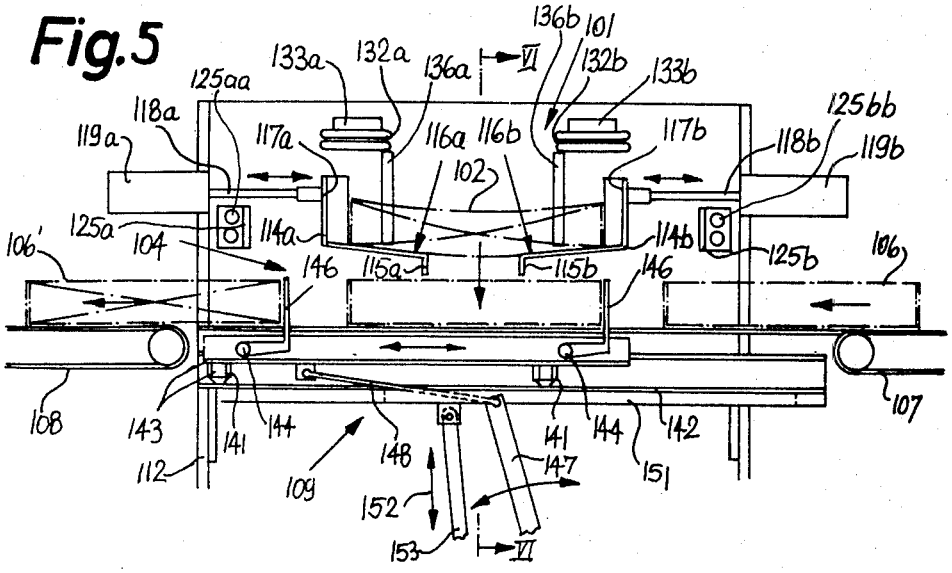
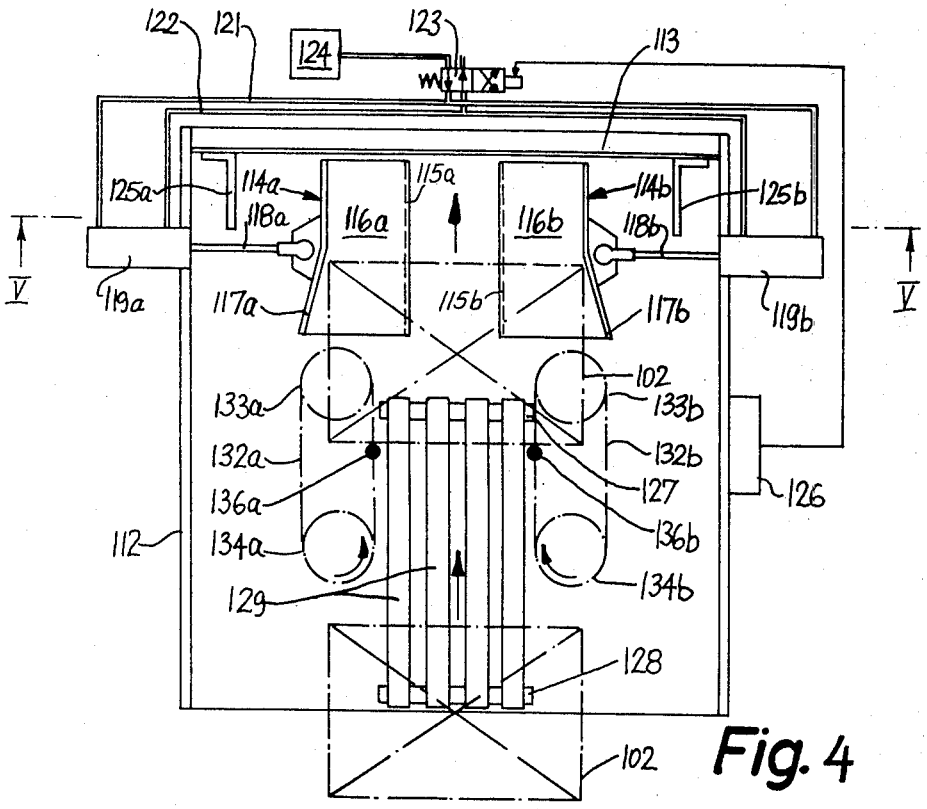
Fig. 4

Fig. 6
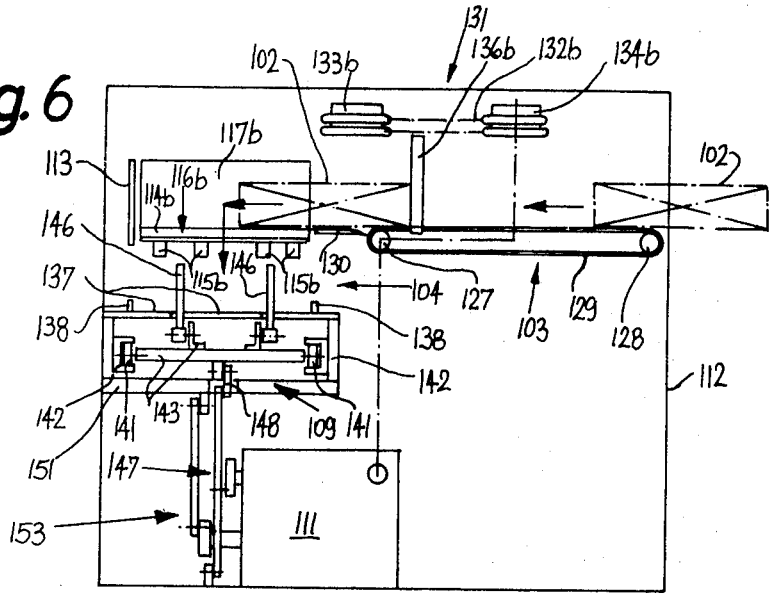
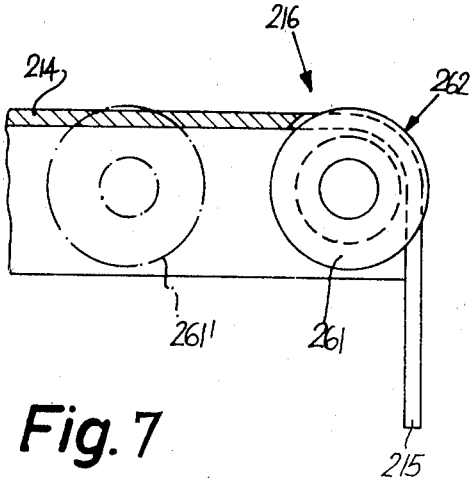
Fig. 7
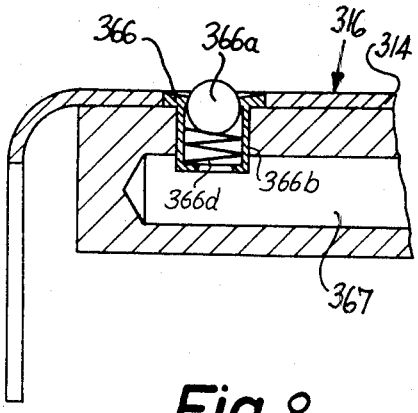
Fig. 8

APPARATUS FOR INTRODUCING STACKS OF PAPER SHEETS INTO BOXES

BACKGROUND OF THE INVENTION

The present invention relates to apparatus for introducing stacks of paper sheets or the like into containers, e.g., into boxes made of thick paper, cardboard or similar material.

It is already known to fill containers (hereinafter called boxes for short) in an apparatus wherein a receptacle for stacks of paper sheets has an open side for introduction of stacks into its interior and is vertically movable between a raised position in which it receives a stack of sheets from a suitable conveyor or the like and a lower position in which it is ready to discharge its contents into a box therebelow. As a rule, the conveyor which supplies stacks delivers successive stacks into a position of abutment with a stop, whereupon a pusher transfers the arrested stack into the receptacle. The bottom of the receptacle consists of two flaps which are pivotably secured to the respective side walls and can be moved between substantially horizontal positions in which they support the stack from below and substantially vertical positions in which they extend into the interior of an empty box when the receptacle is moved to its lower position. The flaps constitute a gate and further serve to guide the descending stack into the interior of the box which is located below and registers with the receptacle.

A drawback of the just described apparatus is that it cannot be used for introduction of stacks into boxes which are dimensioned to receive the stacks without any or with negligible clearance. Furthermore, many types of boxes are rather unstable and tend to undergo pronounced deformation during introduction of stacks. If the side walls of the boxes are deformable, such side walls tend to bulge outwardly during introduction of stacks whereby the upstanding corners of the box move inwardly and prevent the corners of the stack from entering the box. The flaps reduce the likelihood of excessive bulging of at least two side walls because they extend into the interior of the box below the receptacle. However, they interfere with immediate removal of a filled box from a position of register with the receptacle. Furthermore, the receptacle cannot receive a fresh stack prior to return movement to raised position to thereby extract the flaps from the filled box therebelow and prior to subsequent pivoting of the flaps back to their normal stack-supporting positions. The filled box can be replaced with an empty box when the receptacle is raised and its flaps returned to stack-supporting positions. Therefore, the output of the just described apparatus cannot be increased to the extent which is necessary to warrant economic operation of a modern production line wherein the sheets are severed and stacked at an extremely high speed.

OBJECTS AND SUMMARY OF THE INVENTION

An object of the invention is to provide a novel and improved apparatus which can fill boxes with stacks of larger or smaller paper sheets, leaves, plates or the like at a rate greatly exceeding the output of presently known apparatus.

Another object of the invention is to provide the apparatus with novel and improved means for assembly and/or temporary storage of stacks prior to introduction into boxes.

A further object of the invention is to provide the apparatus with novel and improved means for positioning empty boxes with respect to stacks which are about to be admitted into the interior of such boxes.

An additional object of the invention is to provide the apparatus with novel and improved means for moving successive stacks to a position of register with boxes which are about to receive the stacks.

The invention is embodied in an apparatus for introducing stacks of sheets or the like into containers. The apparatus comprises a receptacle which serves for temporary storage of stacks and has a bottom including a plurality of sections movable between first positions in which the sections provide a base for the lowermost sheet of a stack in the receptacle and retracted positions in which the stack is free to descend by gravity, means for feeding stacks into the receptacle, a support for containers below the receptacle, means for delivering empty containers onto the support, one after the other, to a position of register with the receptacle, means for removing filled containers from the support, and means for simultaneously moving the sections of the bottom from the first positions to the retracted positions while the receptacle contains a stack and an empty container on the support registers with the receptacle.

In accordance with a presently preferred embodiment, the bottom comprises two sections which are movable toward and away from each other. Such sections are preferably coplanar or substantially coplanar in each of their positions.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a plan view of an apparatus which embodies one form of the invention;

FIG. 2 is a vertical sectional view as seen in the direction of arrows from the line II—II of FIG. 1;

FIG. 4 is a plan view of a second apparatus;

FIG. 5 is a vertical sectional view as seen in the direction of arrows from the line V—V of FIG. 4;

FIG. 6 is a sectional view as seen in the direction of arrows from the line VI—VI of FIG. 5;

FIG. 7 is an enlarged fragmentary sectional view of a modified bottom section which can be utilized in the receptacle of the apparatus of FIGS. 1–3 or 4–6; and FIG. 8 is a similar enlarged fragmentary sectional view of a different bottom section.

DESCRIPTION OF THE PREFERRED EMBODIMENTS

Figure 3:
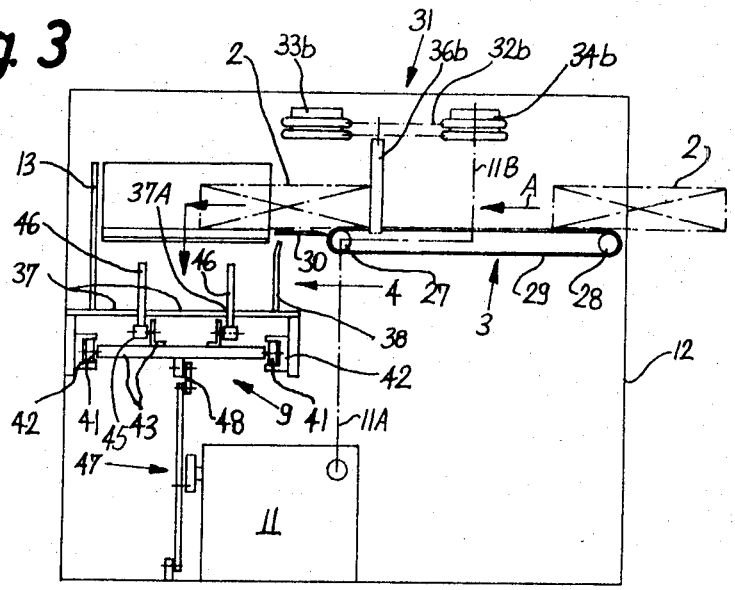
FIG. 3 is a sectional view as seen in the direction of arrows from the line III—III of FIG. 2.

The apparatus of FIGS. 1–3 comprises a stationary receptacle 1 for stacks 2 of paper sheets which are to be transferred into empty containers 6 (e.g., boxes made of cardboard or the like). The means for feeding successive stacks 2 to the receptacle 1 comprises a conveyor 3 which transports the stacks 2 in the direction indicated by arrow A (see FIG. 3). The receptacle 1 is located at a level above a second receptacle 4 which comprises a stationary support or platform 37 for boxes 6. An endless chain or belt conveyor 7 serves to deliver empty boxes 6 to the receptacle 4, and a further endless belt or chain conveyor 8 serves to receive filled boxes 6' from the receptacle 4. The conveyor 7 is in line with the conveyor 8 and the platform 37 of the receptacle 4 is located between these conveyors.

The second receptacle 4 further comprises an advancing and locating unit 9 for empty boxes 6; the purpose of this unit is to insure that an empty box 6 on the platform 37 is in a position of exact or nearly exact register with the receptacle 1. The moving parts are connected with a drive 11, preferably a variable speed transmission, which is mounted in or on the main frame 12 of the apparatus. The transmission 11 receives torque from a main prime mover in a production line which includes the improved apparatus.

The first receptacle 1 comprises a stationary upright end wall 13 and has an open side which is located opposite the end wall 13 and allows for admission of stacks 2 which are fed by the conveyor 3. A stack 2 is properly introduced into the receptacle 1 when its front end face abuts against the end wall 13. The receptacle 1 further comprises a novel and improved bottom which resembles a door with a plurality of slidable panels or sections. The bottom of the receptacle 1 comprises two sections **14*a* and 14*b* which can perform translatory movements toward and away from each other between first positions which are shown in FIGS. 1 and 2 and in which their panels 16*a*, 16*b* constitute a base or table for a stack 2 in the receptacle 1, and second or retracted positions in which the panels 16*a*, 16*b* are spaced apart to establish a gap which is wider than the corresponding dimension of a stack 2 so that the latter can descend by gravity into an empty box 6 on the platform 37 of the second receptacle 4. As shown in FIG. 2, the panels 16*a*, 16*b* are substantially but not exactly coplanar; this causes the median portion of a stack 2 in the receptacle 1 to bulge downwardly and to assume a substantially V-shaped configuration. Such mounting of the panels 16*a*, 16*b* is often desirable because it renders it possible to properly fill a box 6 which is not in exact alinement with the receptacle 1. The sheets of the descending stack 2 slide along one wall of the box 6 in fanwise fashion and find their way into the box, even in the absence of exact registry between 1 and 6. Furthermore, the central portion of the descending stack 2 expels air from the center toward the side walls of the box 6** therebelow and enables such air to escape from the box while the latter is in the process of receiving the stack.

The sections **14*a*, 14*b* of the bottom of the receptacle 1 further comprise upstanding portions 17*a*, 17*b* which constitute two side walls of the receptacle 1 and flank the end wall 13 when the sections 14*a*, 14*b* assume the first positions which are shown in FIG. 2. In such positions of the sections 14*a* and 14*b*, the panels 16*a*, 16*b* constitute the bottom, the wall 13 constitutes one end wall, and the portions 17*a*, 17*b* constitute two side walls of the receptacle 1. The other end wall is absent to provide the aforementioned opening for introduction of successive stacks 2. Those parts of the side walls 17*a*, 17*b* which are nearest to the conveyor 3 flare outwardly to form a convergent inlet for admission of stacks 2 into the receptacle 1**.

The means for moving the sections **14*a*, 14*b* between first and second or retracted positions comprises two motors each of which preferably constitutes a fluid-operated (most preferably pneumatic) cylinder and piston unit. The drawing shows two piston rods 18*a*, 18*b* which are respectively connected with the sections 14*a*, 14*b* and are further connected to pistons (not shown) in double-acting cylinders 19*a*, 19*b* mounted in the frame 12. The chambers of the cylinders 19*a*, 19*b* are connected with a solenoid-operated valve 23 by conduits 21 and 22 in such a way that they move the sections 14*a*, 14*b* toward each other when they receive compressed fluid via conduits 21 and that they abruptly retract the sections 14*a*, 14*b* in response to admission of compressed fluid via conduits 22. The conduits 21 then communicate with the atmosphere. The source of compressed fluid is shown at 24. The valve 23 is actuated in synchronism with movements of various conveyors of the apparatus and with moving parts of other units of the production line to effect abrupt retraction of the sections 14*a*, 14*b* when the receptacle 1 accommodates a stack 2 and the platform 37 supports an empty box 6 below the receptacle 1, and to immediately return the sections 14*a*, 14*b* to first positions as soon as the stack 2 has descended from the receptacle 1 into the box 6 therebelow. The means for actuating the valve 23 comprises a control unit 26 which is connected thereto by conductor means 25. The control unit 26 may comprise a conventional pulse generator including a disk which is driven by the transmission 11 or by the main prime mover of the production line and has one or more magnets which travel past a proximity detector whose output is connected with the valve 23 via conductor means 25**.

The feeding conveyor 3 is an endless conveyor which comprises several endless belts 29 disposed in parallel vertical planes and trained over pulleys 27, 28. The manner in which the stacks 2 are delivered to the upper reaches of the belts 29 forms no part of the present invention. The belts 29 are continuously driven by the pulley 27 which receives torque from the transmission 11. This is indicated by a phantom line 11A which is shown in FIG. 3.

The discharge end of the conveyor 3 is not immediately adjacent to the open end of the receptacle 1. As shown in FIG. 3, successive stacks 2 must advance along the upper side of a horizontal bridge 30 which is mounted in the frame 12 and extends between the pulley 27 and that end of the receptacle 1 which is remote from the end wall 13. The means for transporting successive stacks from the discharge end of the feeding conveyor 3 into the receptacle 1 comprises a transfer conveyor 31 having a first pair of endless chains **32*a* at one side of the bridge 30 and a second pair of endless chains 32*b* at the other side of the bridge. The upper chain 32*a* is disposed in a common horizontal plane with the upper chain 32*b*, and the lower chain 32*a* is disposed in a common horizontal plane with the lower chain 32*b*. These chains are respectively trained over sprocket wheels 33*a*, 34*a* and 33*b*, 34*b*. The chains 32*a* are connected to each other by a vertical entraining element 36*a*, and the chains 32*b* are connected to each other by a vertical entraining element 36*b*. These entraining elements are disposed in a common vertical plane which extends transversely of the path of stacks 2 on the feeding conveyor 3. Thus, when the entraining elements 36*a*, 36*b* approach each other while moving around the rear sprocket wheels 34*a*, 34*b*, they engage the rear side of a stack 2 on the belts 29 and push the stack over the bridge 30 and into the receptacle 1. The elements 36*a*, 36*b* then move away from each other while travelling around the front sprocket wheels 33***a*, 33*b* and thereupon move rearwardly toward the sprocket wheels 34*a*, 34*b* with the outer stretches of the respective chains 32*a*, 32*b*.

The means for driving the transfer conveyor 31 is indicated by the phantom line 11B. As shown in FIG. 3 for the sprocket wheels 34*b*, the sprocket wheels 34*a* and 34*b* receive torque from the pulley 27 for the belts 29. The operative connections may include shafts, bevel gears and similar conventional torque transmitting elements.

The lower receptacle 4 comprises the aforementioned platform or support 37 and two side walls which are spaced apart by a distance corresponding to the width of a box 6. One of these side walls is the lower portion of the end wall 13 of the upper receptacle 1, and the other side wall of the receptacle 4 is shown at 38. The wall 38 is stationary, the same as the wall 13. It is clear that the wall 13 can be replaced with two discrete walls one of which constitutes the end wall of the receptacle 1 and the other of which constitutes one side wall of the receptacle 4.

The aforementioned advancing and locating unit 9 is arranged to move stepwise or continuously between a front end position (shown in FIG. 2) and a rear end position. This unit comprises a carriage 43 which is mounted on wheels 41 guided by rails 42 which are mounted in the main frame 12. The rails 42 extend at right angles to the direction of travel of stacks 2 on the belts 29 of the feeding conveyor 3. The carriage 43 is provided with pivotable pushers 46 which are secured thereto by shafts 44 and can move between the upright positions shown in FIG. 1 and horizontal positions in which they are located at a level below the platform 37. The latter is formed with suitable slots 37A to allow for pivoting of pushers 46 between upright and horizontal positions. The mechanisms which cause the pushers to move between their end positions are schematically indicated at 45; however, the exact nature of such mechanisms forms no part of the invention. For example, each such mechanism may comprise a rotary electromagnet which is energized or deenergized by limit switches which are adjacent to the path of movement of the carriage 43 and are actuatable by trips on the carriage to cause the pushers 46 to rise or descend in predetermined positions of the carriage.

The means for moving the carriage 43 back and forth comprises a crank drive 47 which derives motion from the transmission 11 and a link 48 which is articulately connected to the carriage. The purpose of the carriage 43 is to accept empty boxes 6 from the delivering conveyor 7, to locate such empty boxes below the receptacle 1 prior to movement of the sections 14*a*, 14*b* to retracted positions, and to transfer filled boxes 6' onto the receiving conveyor 8.

As mentioned above, the transmission 11 can be driven by the main prime mover of the production line which embodies the apparatus of FIGS. 1 to 3. Such production line can sever large sheets of paper lengthwise and crosswise to form blanks or smaller sheets of desired size, and the blanks are thereupon stacked prior to delivery into the range of the feeding conveyor 3. The conveyor 8 can deliver filled boxes 6' to a station where the boxes are provided with covers or to another destination.

The unit 9 can be said to form part of a composite means for delivering empty boxes 6 to a position of register with the receptacle 1. By the same token, the unit 9 can be said to form part of a composite receiving means which further includes the conveyor 8. The side walls 13, 38 of the receptacle 4 define an elongated path along which empty and filled boxes 6 and 6' can advance from the conveyor 7 onto the conveyor 8.

The operation:

The transfer conveyor 31 is in the process of advancing a fresh stack 2 into the receptacle 1 (see particularly FIG. 3), and the carriage 43 maintains an empty box 6 in a position of register with the receptacle 1, i.e., below the sections 14*a*, 14*b* which are held in their first positions. As the conveyor 31 continues to advance the stack 2 into the receptacle 1 (i.e., toward abutment with the wall 13), the mechanisms 45 cause the pushers 46 to pivot to a level below the platform 37 so that the carriage 43 is free to move backwards without shifting the properly positioned empty box 6 which rests on the platform 37. The pushers 46 are erected again when the front pushers are located behind the box 6 on the platform 37 and when the rear pushers are located behind the foremost empty box 6 on the delivery conveyor 7.

The stack 2 which is pushed over the bridge 30 reaches the end wall 13 when the entraining elements 36*a*, 36*b* begin to travel around the front sprocket wheels 33*a*, 33*b* of the transfer conveyor 31. The control unit 26 then transmits a signal which causes the valve 23 to admit compressed fluid into the conduits 22 and to connect the conduits 21 with the atmosphere. The pistons in the cylinders 19*a*, 19*b* cause the respective piston rods 18*a*, 18*b* to abruptly retract the sections 14*a*, 14*b* whereby the panels 16*a*, 16*b* slide from below the lowermost sheet of the stack 2 in the receptacle 1 and allow the stack to descend by gravity into the empty box 6 on the platform 37. The carriage 43 thereupon moves forwardly and its front pushers 46 advance the filled box 6' along the platform 37 and onto the receiving conveyor 8. At the same time, the rear pushers 46 of the carriage 43 advance the foremost empty box 6 from the delivery conveyor 7 onto the platform 37. The walls 13 and 38 of the lower receptacle 4 are adjacent to the outer sides of two side walls of the box 6 on the platform 37 so that such side walls of the box cannot bulge outwardly during entry of a stack 2. The other two walls of the box 6 are assumed to be twin walls so that they are less likely to bulge outwardly during introduction of a stack. Furthermore, by properly propping two side walls, the likelihood that the other two walls of the box 6 will or might undergo pronounced deformation during admission of a stack 2 is very remote.

The solenoid of the valve 23 is deenergized immediately after the stack 2 descends into the box 6 on the platform 37. Thus, the sections 14*a*, 14*b* reassume the positions of FIG. 1 and the receptacle 1 is ready to receive the next stack 2. Such stack is delivered by the transfer conveyor 31 in the same way as described above. The sections 14*a*, 14*b* can be moved apart as soon as the oncoming stack 2 reaches the end wall 13 of the upper receptacle 1. As mentioned above, the movements of all conveyors are synchronized with movements of the carriage 43, pushers 46 and sections 14*a*, 14*b* to insure that the length of intervals between filling of successive boxes 6 depends primarily on the length of that interval which is required for gravitational descent of a stack 2 from the receptacle 1 into a box 6 on the platform 37.

The apparatus of FIGS. 1–3 is susceptible of many modifications without departing from the spirit of the invention. For example, the transfer conveyor can be omitted if the discharge end of the conveyor 3 extends all the way to the open side of the receptacle 1 so that the conveyor 3 can advance stacks 2 into abutment with the end wall 13. Furthermore, the advancing and locating means 9 can be replaced with an endless conveyor with pushers which descend to a level below the upper reach of the conveyor 8 as soon as they complete the delivery of a filled container 6' and rise above the upper reach of the conveyor 7 when they return to a position behind the foremost empty box 6 on the conveyor 7. Still further, the end wall 13 can be omitted if the conveyor 3 or 31 is designed to advance successive stacks 2 to a predetermined position of accurate register with an empty box 6 on the platform 37. Also, the conveyors 7 and 8 need not transport empty and filled boxes in a direction at right angles to the direction of transport of stacks 2 on the conveyor 3.

The output of the apparatus of FIGS. 1–3 greatly exceeds the output of the aforediscussed conventional apparatus. It has been found that the apparatus of FIGS. 1–3 is especially suited for boxing or crating of stacks which consist of relatively small sheets, leaves or plates. Problems could arise when the sheets, leaves or plates are relatively large, e.g., corresponding in size to German DIN A 1 or DIN A 0 norms. Such problems develop mainly during movement of the bottom sections to their retracted positions because the orientation of relatively large sheets, leaves or plates (hereinafter called sheets) is likely to change during gravitational descent into an empty container or box below the first receptacle. One of the reasons for such change in orientation is that the flexibility of a relatively large stack (namely, a stack consisting of leaves having a pronounced length and/or width) greatly exceeds the flexibility of a relatively compact stack consisting of overlapping sheets having a relatively small width and/or length. In order to adequately support the lowermost sheet of a stack of large leaves, the sections of the bottom must constitute a large table which presents a practically continuous upper surface for the lowermost sheet of the stack. Consequently, the sections must cover a substantial distance during movement to retracted positions whereby the median portion of the stack of large sheets begins to bulge downwardly as the width of the gap between the sections increases. In other words, the median portion of the lowermost large sheet forms a loop while the marginal portions of the lowermost sheet still contact the respective sections during movement of sections to their retracted positions. Moreover, the upper layer of the stack exhibits a tendency to roll while the median portion of the stack bulges downwardly in the gap between the sections during movement of sections to their retracted positions. This, in turn, prevents the stack from descending into the box therebelow in the form of a solid block-shaped body or slab, i.e., certain sheets (especially the uppermost sheets) exhibit a tendency to come to rest by abutting with one of their major sides against a side wall of the box.

The just discussed problems can be avoided by resorting to an apparatus which is shown in FIGS. 4–6. All such components of this apparatus which are identical with or clearly analogous to corresponding components of the first apparatus are denoted by similar reference characters plus 100 and are not described again.

One of the main differences between the apparatus of FIGS. 1–3 and 4–6 is that the panels 116*a*, 116*b* of the sections 114*a*, 114*b* comprise downwardly extending guide portions in the form of vertical or substantially vertical plates or strips 115*a*, 115*b* which are parallel or nearly parallel to each other and are relatively thin, at least in the region of their lower ends which are remote from the lowermost sheet of a stack 102 in the receptacle 101. The sheets of the stack 102 are assumed to be relatively long and/or wide so that the stack 102 is readily flexible, especially if its sheets consist of relatively thin paper. The guide portions or strips 115*a*, 115*b* need not be very long, as considered in a direction toward the open upper end of a box 106 below the receptacle 101.

The apparatus of FIGS. 4–6 further comprises two arresting devices 125*a*, 125*b* which are respectively located in the paths of movement of the sections 114*a*, 114*b* to their retracted positions and serve to arrest the sections when the strips 115*a*, 115*b* are located at a predetermined distance from each other, namely, at a distance which equals or approximates the width or length of sheets constituting a stack 102. The arresting devices 125*a*, 125*b* are secured to the end wall 113, preferably in such a way that they can be adjusted in order to conform the maximum distance between the strips 115*a*, 115*b* to the width or length of sheets of successively supplied stacks 102. To this end, the end wall 113 may be formed with several sets of tapped bores (not specifically shown) for the screws or bolts 125*aa*, 125*bb* which secure the respective arresting devices 125*a*, 125*b* to the end wall 113.

The second receptacle 104 has two parallel side walls 138 which extend upwardly from the support 137 and define a space having a width corresponding to that of a box 106. The rails 142 for the carriage 143 are mounted in a frame member 151 which is movable up and down in the main frame 112 in directions indicated by the double-headed arrow 152. The frame member 151 forms part of means for varying the distance between the support 137 and the receptacle 101, and such means further includes a mechanism for moving the frame member 151 up and down. The mechanism includes a crank drive having a link 153 which is articulately connected to the frame member 151 and receives motion from the transmission 111.

The operation of the apparatus of FIGS. 4 to 6 is analogous to that of the first apparatus. The transfer conveyor 131 is shown in the process of delivering a stack 102 into the receptacle 101, and the advancing and locating unit 109 maintains an empty box 106 in register with the receptacle 101, i.e., such box is located in the second receptacle 104. As the stack 102 advances toward the end wall 113, the carriage 143 of the unit 109 is moved rearwardly under the action of the crank drive 147 and the pushers 146 are caused to pivot counterclockwise, as viewed in FIG. 5, and to reassume their erected positions when the left-hand pushers are located behind the empty box 106 below the receptacle 101 and the right-hand pushers are located behind the foremost empty box 106 on the delivering conveyor 107. The frame member 151 is thereupon lifted by the link 153 to such an extent that the lower end portions of the strips 115*a*, 115*b* are close to or extend into the open top of the box 106 on the support 137. In the meantime, the stack 102 reaches the end wall 113 whereupon the control unit 126 energizes the solenoid of the valve 123, i.e., the pistons in the cylinders 119*a*, 119*b* cause the respective piston rods 118*a*, 118*b*, to abruptly move the sections 114*a*, 114*b* of the bottom of the receptacle 101 to retracted positions, namely, into abutment with the arresting devices 125*a*, 125*b*. The lower end portions of or the entire strips 115*a*, 115*b* come into contact with the respective inner surfaces of the empty box 106 on the support 137. This insures that the box 106 is properly oriented with respect to the receptacle 101 and that it is not unduly deformed, i.e., that its open top permits the descending stack 102 to enter the box in an optimum position. During such downward movement, two sides of the descending stack 102 are guided by the inner surfaces of the strips 115*a*, 115*b*, i.e., the strips 115*a*, 115*b* constitute a duct wherein the stack 102 descends. In the next step, the link 153 returns the frame member 151 to the lower end position, i.e., the distance between the receptacle 101 and the support 137 is increased. This moves the filled box 106' into register with the receiving conveyor 108 and the crank drive 147 thereupon causes the carriage 143 to advance the filled box 106' onto the conveyor 108 while simultaneously advancing the foremost empty box 106 into register with the receptacle 101.

The sections 114*a*, 114*b* move toward each other in response to deenergization of the solenoid of the valve 123 immediately after the frame member 151 assumes its lower end position or as soon as this frame member assumes an intermediate position in which the strips 115*a*, 115*b* are located at a level above the freshly filled box 106'. Thus, the receptacle 101 is ready to accept the next stack 102 which is delivered by the transfer conveyor 131.

The apparatus of FIGS. 1–3 or FIGS. 4–6 can be modified by omitting the conveyors 3, 31 or 103, 131 and by accumulating the stacks 2 or 102 directly in the receptacle 1 or 101. In other words, the panels 16*a*, 16*b* or 116*a*, 116*b* then form a table on which a succession of sheets accumulate to form a stack which is thereupon caused to descend onto the support 37 or 137 in response to movement of sections 14*a*, 14*b* or 114*a*, 114*b* to their retracted positions. The conveyors 3, 31 or 103, 131 are then replaced with other conveyor means which can deliver discrete sheets, or smaller groups of sheets, directly into the receptacle 1 or 101. In such apparatus, the receptacle 1 or 101 need not have an open side opposite the end wall 13 or 113 because discrete sheets or smaller groups of sheets can be supplied from above.

Friction between the lowermost sheet of a relatively compact stack (namely, a stack which consists of relatively small sheets) and the upper surfaces of panels 16*a*, 16*b* or 116*a*, 116*b* is not sufficiently pronounced to interfere with retraction of the sections 14*a*, 14*b* or 114*a*, 114*b*. However, when the stack consists of relatively large (long and/or wide) sheets, and the stack is rather high, friction could result in lateral shifting of or damage to the lowermost sheet of the stack. In such apparatus, one or both panels of the bottom sections of the first receptacle are preferably provided with friction reducing means, e.g., with one or more rotary elements in the form of idler rolls 261, 261' which are shown in FIG. 7. The idler roll 261 has a peripheral surface 262 which extends slightly beyond the upper side of the panel 216 of the section 214 so that the lowermost sheet of a stack (not shown in FIG. 7) rests on the peripheral surface 262. The other idler roll or rolls 261' are optional; therefore, the roll 261' is indicated by phantom lines. A portion of the peripheral surface 262 of the idler roll 261 also extends beyond the inner side of the guide portion or strip 215 to further enhance predictable descent of a stack into the empty box below the receptacle which includes the section 214. The idler rolls 261, 261' can be replaced with spherical rolling elements or with other suitable friction reducing means which contact the underside of the lowermost sheet of a stack. If desired, each section 214 may be provided with an entire battery (one or more rows) of rotary friction reducing elements in the form of idler rolls whose axes are normal to the direction of movement of the support 214 to or from its retracted position. Thus, the number of such rotary elements can be sufficiently large to insure that the lowermost sheet of a stack does not contact the panels 216 of the supports 214.

FIG. 8 illustrates modified friction reducing means in the panel 316 of a section 314. The section 314 is provided with a plenum chamber 367 which is connected with a suitable source (e.g., 24 or 124) of compressed air or another gaseous fluid and can discharge compressed air against the underside of the lowermost sheet of a stack by way of one or more openings 366*b* in the panel 316. Each opening 366*b* preferably contains a ball check valve having a seat 366, a spherical valving element 366*a* and a spring 366*d* which biases the element 366*a* against the seat 366. When the panel 316 supports a portion of a stack, the latter depresses the element 366*a* against the opposition of the spring 366*d* so that the opening 366*b* admits compressed air from the plenum chamber 367 against the underside of the lowermost sheet of the stack. This, coupled with friction reducing action of the rolling element 366*a*, insures that the section 314 can readily slide with respect to the lowermost sheet during movement to the retracted position. As mentioned above, each panel 316 can be provided with several openings 366*b* each of which may contain a ball check valve or another suitable one-way valve. Compressed fluid which issues from the chamber 367 via opening or openings 366*b* forms a cushion between the upper side of the panel 316 and the adjacent portion of the underside of the lowermost sheet, i.e., the stack actually floats on a cushion of air and remains in optimum position during movement of the section 314 to its retracted position.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

I claim:

1. Apparatus for introducing stacks of sheets into containers, comprising (a) a receptacle for stacks, said receptacle having a bottom including a plurality of sections movable toward and away from each other between first positions in which said sections provide a base for the lowermost sheet of a stack in said receptacle and retracted positions in which such stack is free to descend by gravity, said sections being substantially coplanar in each of said positions thereof;

(b) means for feeding stacks seriatim into said receptacle;

(c) a support for containers disposed below said receptacle;

(d) means for delivering empty containers onto said support, one after the other, to a position of register with said receptacle;

(e) means for receiving filler containers from said support; and (f) means for simultaneously moving said sections from said first to said retracted positions while said receptacle contains a stack and an empty container on said support registers with said receptacle.

2. Apparatus as defined in claim 1, wherein said bottom includes two sections.

3. Apparatus as defined in claim 1 for introducing stacks of sheets into containers of predetermined width, further comprising two side walls extending above said support and spaced apart by a distance at least approximating said width, said delivering means comprising means for locating successive empty containers between said side walls.

4. Apparatus as defined in claim 3, wherein said receptacle has an open side and further comprises an end wall located opposite said open side and parallel to said side walls.

5. Apparatus as defined in claim 3, wherein said delivering means further comprises a first conveyor at one side of said support and said receiving means comprises a second conveyor disposed at the other side of said support and aligned with said first conveyor, said support and said side walls defining a path along which containers can advance from said first to said second conveyor.

6. Apparatus as defined in claim 5, further comprising a frame, said side walls being secured to said frame.

7. Apparatus as defined in claim 1, wherein said delivering means comprises a carriage movable back and forth along said support and including means for locating empty containers in said position of register with said receptacle.

8. Apparatus as defined in claim 7, wherein said locating means comprises at least one first pusher arranged to move an empty container to said position of register while said carriage moves in a predetermined direction and at least one second pusher arranged to simultaneously move a filled container from said position of register to said receiving means.

9. Apparatus as defined in claim 1, wherein said moving means comprises a discrete fluid-operated motor for each of said sections and means for simultaneously actuating said motors.

10. Apparatus as defined in claim 1, wherein said sections include stack-supporting portions which slope downwardly toward the center of a stack in said receptacle.

11. Apparatus as defined in claim 1, wherein said receptacle has an open side and said feeding means includes conveyor means having a discharge end immediately adjacent to the open side of said receptacle.

12. Apparatus as defined in claim 1, wherein said receptacle has an open side and said feeding means comprises an endless conveyor having a discharge end spaced apart from the open side of said receptacle and a transfer conveyor having entraining means arranged to transport stacks from said discharge end into said receptacle by way of said open side.

13. Apparatus as defined in claim 1, wherein said feeding means comprises at least one conveyor and said delivering means comprises mobile advancing means for locating empty containers in said position of register with said receptacle, and further comprising common drive means for said conveyor and said advancing means.

14. Apparatus as defined in claim 1, wherein said sections comprise portions which constitute side walls of said receptacle in said first positions of said sections.

15. Apparatus as defined in claim 1, wherein said sections comprise guide means extending downwardly at least in the retracted positions of said sections and defining a duct wherein a stack descends from said receptacle into the container therebelow.

16. Apparatus as defined in claim 15, further comprising means for arresting said sections in said retracted positions so as to maintain said guide means at a predetermined distance from each other.

17. Apparatus as defined in claim 16, wherein said bottom comprises two sections and the guide means of said sections are substantially parallel to each other, the distance between said guide means in the retracted positions of said two sections approximating the width or the length of said stacks.

18. Apparatus as defined in claim 15, further comprising means for varying the distance between said support and said receptacle.

19. Apparatus as defined in claim 18, wherein said distance varying means is operative to reduce said distance prior to movement of said sections to the retracted positions thereof so that said guide means are at least close to the empty container on said support while such container registers with said receptacle.

20. Apparatus as defined in claim 15, wherein said guide means include relatively thin lower end portions which are adjacent an empty container on said support.

21. Apparatus as defined in claim 1, wherein at least one of said sections has at least one opening for admission of compressed gaseous fluid below the lowermost sheet of a stack in said receptacle, and further comprising a source of compressed fluid connected to said opening.

22. Apparatus as defined in claim 21, further comprising one-way valve means installed in said opening and arranged to open in response to introduction of a stack into said receptacle.

23. Apparatus as defined in claim 22, wherein said valve means comprises a check valve having a valving element normally extending upwardly beyond the respective section and being depressible by a stack which descends onto said sections to thereby open said valve.

24. Apparatus as defined in claim 1, wherein at least one of said sections comprises at least one rotary element having a portion extending upwardly beyond said bottom and arranged to turn as a result of contact with a stack in said receptacle during movement of said sections to the retracted positions thereof.

25. Apparatus as defined in claim 24, wherein said rotary element is an idler roll.

* * * * *

UNITED STATES PATENT AND TRADEMARK OFFICE

CERTIFICATE OF CORRECTION

PATENT NO. : 4,237,674

DATED : December 9, 1980

INVENTOR(S) : Kurt AYKUT

It is certified that error appears in the above-identified patent and that said Letters Patent are hereby corrected as shown below:

Foremost page, Item [73], "Hauni-Werke Körber & Co. KG," should read --E. C. H. Will (GmbH & Co.),--.

Signed and Sealed this

*Tenth* Day of *March 1981*

[SEAL]

*Attest:*

RENE D. TEGTMEYER

*Attesting Officer*

*Acting Commissioner of Patents and Trademarks*